United States Patent [19]

Glackin

[11] Patent Number: 4,866,799

[45] Date of Patent: Sep. 19, 1989

[54] FIRE RETARDANT MATTRESS

[76] Inventor: Steven F. Glackin, 4525 Tarry La., Wilmington, Del. 19804

[21] Appl. No.: 62,726

[22] Filed: Jun. 15, 1987

Related U.S. Application Data

[63] Continuation-in-part of Ser. No. 669,954, Nov. 9, 1984, abandoned, which is a continuation-in-part of Ser. No. 749,520, Jun. 27, 1985, abandoned.

[51] Int. Cl.[4] ..... A47C 27/00

[52] U.S. Cl. ..... 5/459; 5/474; 5/475

[58] Field of Search ..... 5/261, 459, 474–480

[56] References Cited

U.S. PATENT DOCUMENTS

| | | | |
|---|---|---|---|
| 3,512,192 | 5/1970 | Simon | 5/459 |
| 3,818,521 | 5/1974 | Richards, Jr. | 5/459 |
| 3,848,283 | 11/1974 | Ikeda | 5/474 |
| 3,857,126 | 12/1974 | Woodruff | 5/459 |
| 4,463,466 | 8/1984 | May et al. | 5/478 X |

FOREIGN PATENT DOCUMENTS

| | | | |
|---|---|---|---|
| 647383 | 8/1962 | Canada | 5/459 |
| 2067896 | 8/1981 | United Kingdom | 5/459 |

*Primary Examiner*—Michael F. Trettel
*Attorney, Agent, or Firm*—Samuel V. Abramo

[57] ABSTRACT

A fire retardant mattress comprising a central coiled spring support assembly, a first layer of polyurethane foam and/or matting covering on the top and bottom of said support assembly, a second layer of a fire resistant resilient material preferably polychloroprene foam covering the surface of said first top and bottom layers and a fire shield composed preferably of a woven fiber glass material attached to the edge of the perimeter of said second top and bottom layers to completely encapsulate the support assembly and first layers in a fire retardant capsule; said fire shield having sufficient slack to allow the springs of the mattress to expand due to the effect of heat and fire and thus preventing the rupturing of the integrity of the mattress and exposure of the polyurethane foam and matting to flames by said expanding springs and thereby preventing the inner contents of the mattress from coming in contact with fire and/or burning with a concommitant sudden release of heat and smoke.

7 Claims, 5 Drawing Sheets

FIRE RETARDANT MATTRESS

CROSS-REFERENCED TO OTHER APPLICATIONS

This application is a continuation-in-part of my application, Ser. No. 669,954, filed November 9, 1984, now abandoned and a continuation-in-part of my application, Ser. No. 749,520, filed June 27, 1985, now abandoned.

FIELD OF THE INVENTION

This invention relates to mattresses and seat cushions and more particularly to fire retardant mattresses and seat cushions which have an internal coiled resilient spring support element. The mattress is composed of a plurality of coiled springs joined together in a spring assembly which is covered with polyurethane foam and/or matting material to provide cushioning and said polyurethane or matting covered spring assembly. Said covered spring assembly is encapsulated in a fire retardant capsule which is generally covered with a cover. The mattresses and seat cushions of this invention are capable of withstanding a moderate amount of burning without rupturing due to expansion of said coiled resilient springs caused by heat because the fire retardant capsule is specifically designed to have sufficient slack to allow the expansion without being ruptured.

SUMMARY OF THE PRIOR ART

In general, mattresses and seat cushions preferably have been manufactured by covering an assembly or support of coiled springs with a combination of polyurethane foam and/or matting which is then enclosed in a cover made of ticking or other material. This combination provides lightness, durability and comfort at a reasonable cost.

These mattresses and cushions have been found to be extremely dangerous in fires because of the thermal degradation of the polyurethane foam and matting which form combustible liquids and/or gases which can be suddenly released by the coils which have expanded due to heat created by the fire causing individual coils to rip through the surface of the mattress or cushion suddenly releasing the gaseous and the liquidfied polyurethane or matting degradation products. These degradation products can burn with near explosive force when contacted by fire. The end result is that even in a moderate fire a person in a room containing a burning mattress or cushion may be overcome by by a sudden increase in heat and smoke created by the sudden rupture of a burning mattress which can occur in one or two minutes from the time of ignition of bed clothing on the mattress. Many persons have been injured or killed by being trapped in hotel rooms because of the explosive nature of mattress fires. The danger is particularly acute in high rise hotels and hospitals containing many beds where a patron inadvertently sets the bed in their room on fire by carelessly smoking cigarettes or by emptying unextinguished cigarettes into waste containers which then catch on fire setting the bed on fire.

Others have attempted to design mattresses which are fire retardant. Mattresses such as those described by Simon, U.S. Pat. No. 3,512,192 are composed of layers of polyurethane foam covered by a layer of fiber glass matting which produces irritating glass fibers. Ikeda, U.S. Pat. No. 3,848,283 describes a mattress totally encapsulated within polychloroprene with the edge of the mattress having a block in the form of a wedge of polychloroprene which fills in the space between the top and bottom layers of polychloroprene. If the Ikeda mattress is exposed to heat or fire causing the inner springs to expand the sides of the mattress would separate due to the force of the expanding springs or the expanding springs would rupture either or both the top and bottom layers also exposing the inner springs.

I have discovered a light, comfortable, durable mattress having an internal coil resilient spring assembly covered with polyurethane foam and/or other materials and encapsulated by a combination of a fire shield and fire resistant material which greatly decreases the likelihood of a mattress being engulfed in flame and which is capable of withstanding a moderate amount of heat, flames and burning without the expanding spring rupturing the integrity of the mattress, thus, greatly reducing the danger described above. My mattress is enclosed in a fire retardant barrier constructed with sufficient slack to permit the mattress to expand if the springs expand due to heat from a fire. In general, the fire retardant barrier has sufficient slack that it provides a width to the fire retardant capsule which is 0.5 to 1.5 times the height of the mattress. It is convenient to gather the excess or extra slack of the fire shield into a fold which is retained by a retainer band composed of a material which will burn and which on burning releases the slack portion of the fire shield. The encapsulated mattress is covered with a mattress cover made of a material which in general provides a "rich" appearance such as satin or even a fire retardant material. It is preferable that the fire shield is composed of a material which would retain its integrity in a small to moderate fire. The use of an expandable fire retardant capsule greatly minimizes the amount of flame generated by the mattress in a moderate fire and, thus, provides precious time to allow a person to exit from a burning structure housing the mattress.

SUMMARY OF THE INVENTION

This invention is directed to fire retardant mattresses and cushions and comprising:

a fire retardant mattress having resilient springs in a frame said springs being covered with flammable padding and foam to form a covered spring comprising a fire retardant capsule which encloses said padding and cover springs and which has sufficient slack to permit thermal expansion of the springs up to double in length due to fire or heat without rupturing the fire retardant capsule and exposing the flammable padding and foam to fire.

My mattress is more specifically described as a fire retardant mattress comprising:

(a) a central resilient spring assembly support comprising a plurality of coiled springs arranged in a frame having a top side, a bottom side and a peripheral edge separating the top and bottom sides;

(b) a first layer comprising resilient polyurethane foam, matting or a combination of polyurethane foam and matting attached to and covering each said top and bottom sides of the resilient spring assembly support and extending beyond the top side edge and the bottom side edge to form a channel comprising the springs in the resilient spring assembly support and the extension of the first layers extending over said top and bottom edges;

(c) a second layer comprising a resilient fire retardant material placed adjacent to and covering the first layer attached to the top and bottom sides of the resilient spring assembly support; and (d) a fire shield composed of a flame resistant material attached to said second layer or to said first and second layers at the point of extension over said top and bottom edges of the resilient spring assembly support completely encapsulating said central resilient spring assembly support and first and second resilient layers within a substantially fire retardant capsule.

This invention is also directed to a fire shield for a mattress which encircles the sides of a mattress and which is connected to the top side and the bottom side of the mattress said top side and bottom side being composed of a fire retardant material and has sufficient width to permit the springs to expand due to heat. It can be seen that the inner material of the mattress is thus, completely enclosed within a fire retardant bag or capsule which permits the metal springs to expand due to heat in a moderate fire without rupturing.

In the construction of the mattress the excess fire shield is folded within said channel and held in place by a retractor band or a compressive band having a circumference slightly smaller than the outer perimeter dimension of the mattress. The retractor band is composed of a material which will burn to release the slack fire shield permitting the expansion of the mattress in the event the mattress is exposed to heat. The final assembly is then covered with a cover of satin ticking fabric, treated fabric or other commonly used materials.

DESCRIPTION OF THE PREFERRED EMBODIMENT

Other features and advantages will become more readily apparent from the following description and the accompanying illustrative drawings.

The embodiments of the invention shown in FIGS. 1 through 12 are described below.

Figure 1:
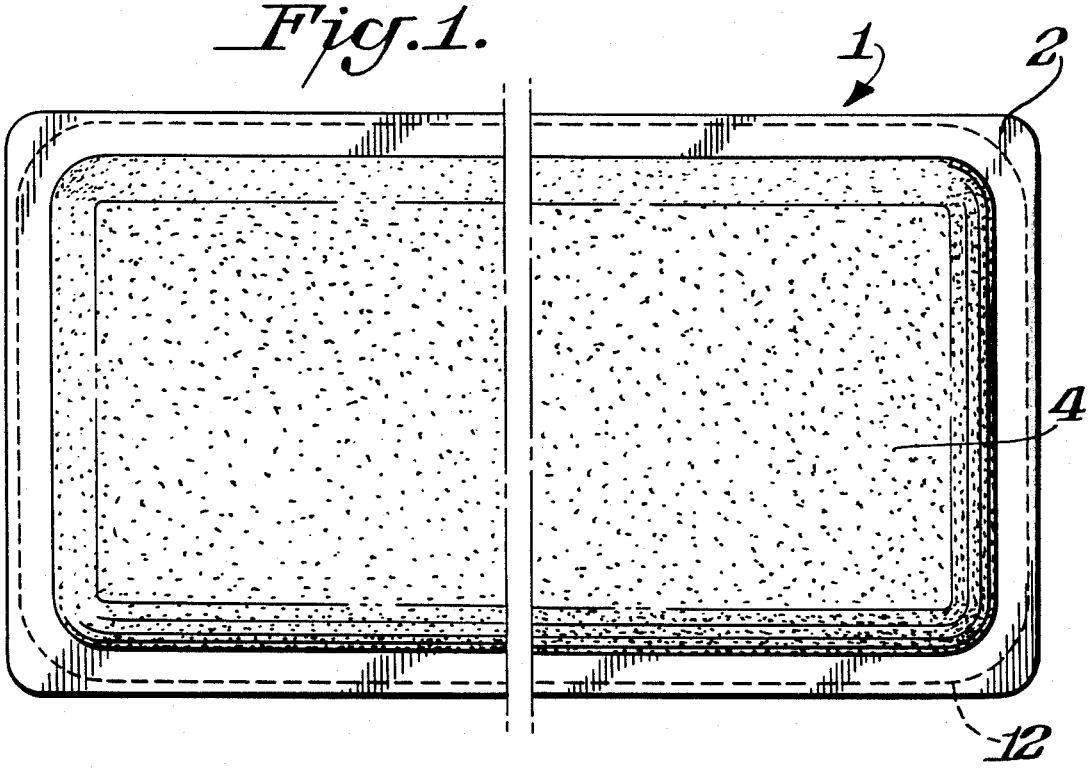
FIG. 1 is a top plan view of the mattress of the present invention in extended position.
Figure 2:
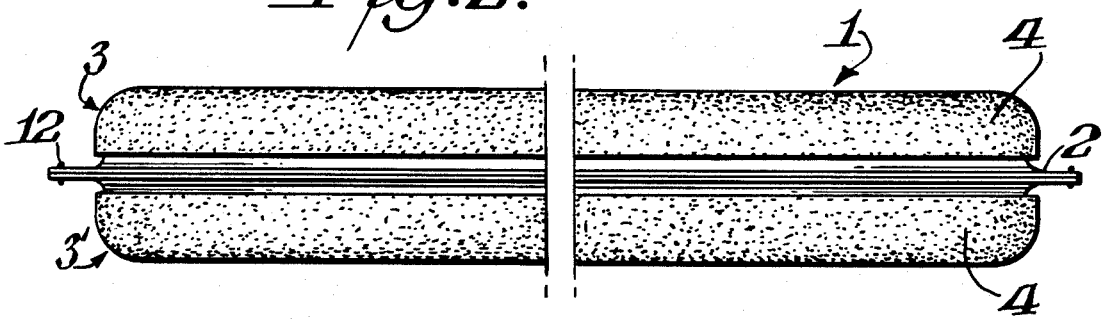
FIG. 2 is a side-elevational view of the mattress of FIG. 1.
Figure 3:
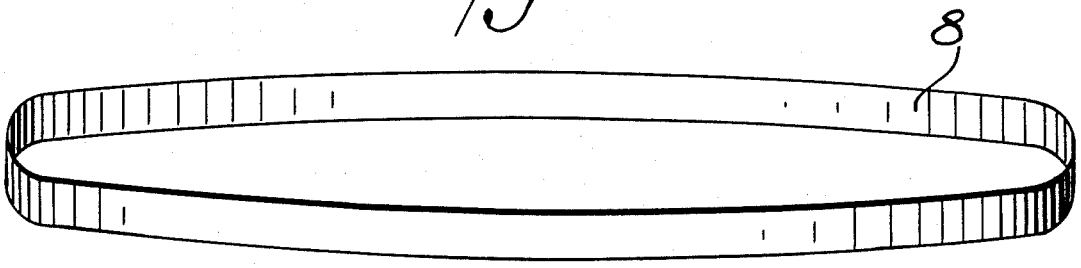
FIG. 3 is a pictorial view of the retractor band utilized to maintain the fire shield in folded position.
Figure 4:
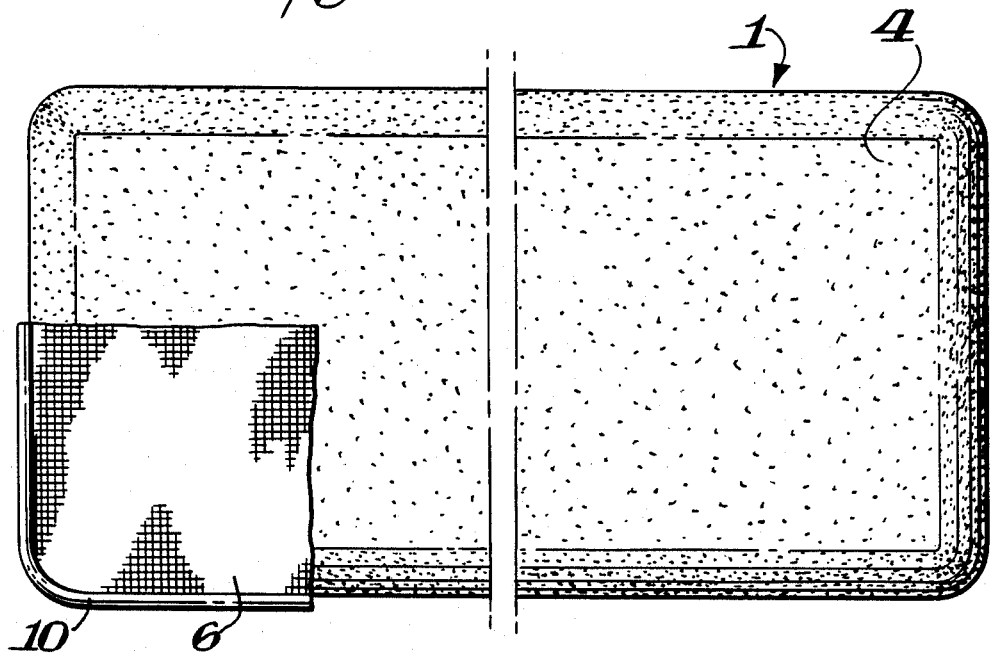
FIG. 4 is a top plan view of the mattress of the present invention showing a portion of the outer cover and the fire resistant resilient layer.
Figure 5:
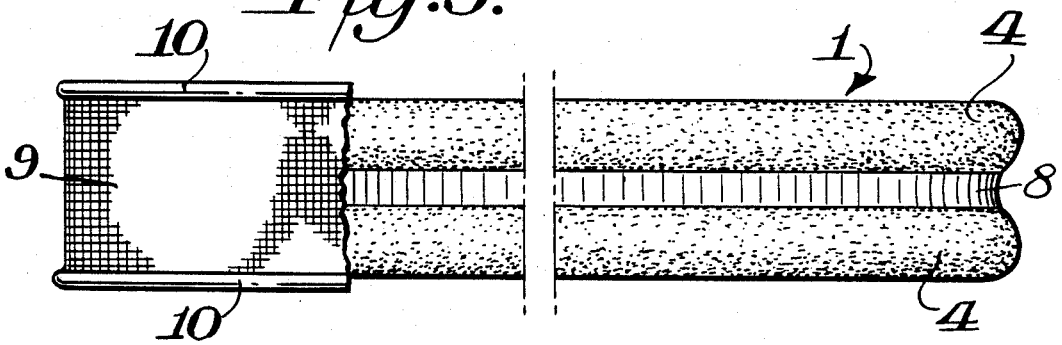
FIG. 5 is a side-elevational view of the mattress of FIG. 4.
Figure 6:
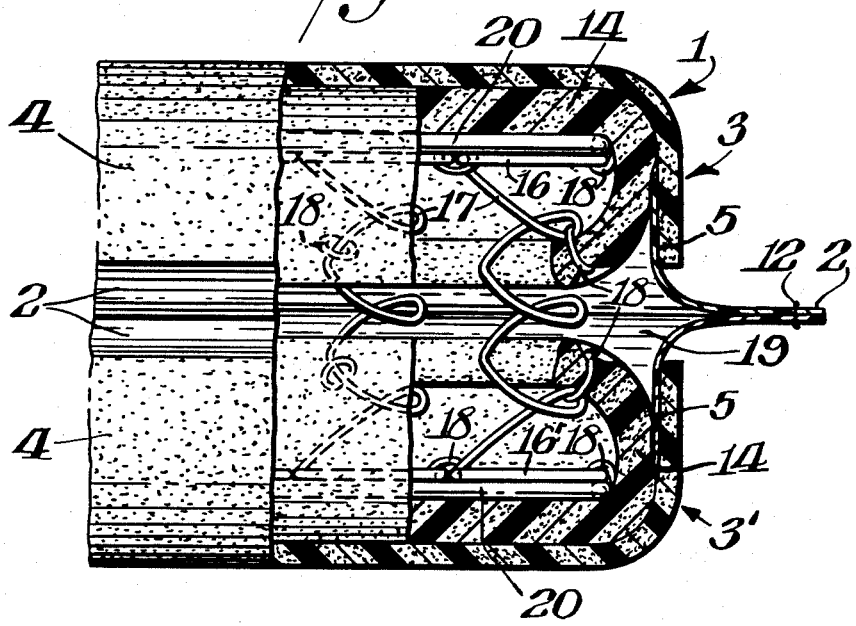
FIG. 6 is a cross-sectional view of the embodiment of FIG. 1.
Figure 7:
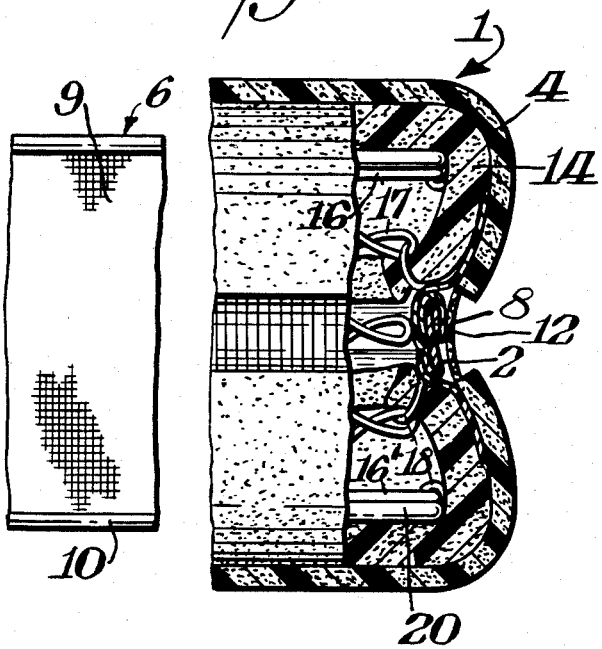
FIG. 7 is a cross-sectional view of the embodiment of FIGS. 4 and 5.

The mattress of FIG. 1 is shown to have a central resilient spring support assembly composed of coiled springs 17 attached to frame 16 having a perimeter slightly smaller than the desired mattress. The coiled springs are clamped to the frame 20 by spring frame anchor clamps or hog rings 18. The entire top 16 and bottom 16' sides of the spring assembly is covered with a first layer 14 composed of polyurethane foam, matting or a combination of said foam and matting. The first layer can be 0.5 to 2 inches thick but preferably is 0.5 to 1 inch thick. Preferably the first layer overlaps the edges or perimeter of the top and bottom sides of the spring assembly and are clamped to the outermost springs by foam anchor clamps or hog rings 18. The first layer is attached to the frame by anchor clamps or hog rings 18. In this preferred embodiment, a channel or cavity 19, running the entire perimeter of the mattress is formed by the first layers which overlap the edges of the top and bottom sides of the spring assembly and the outermost springs of the spring assembly. A second layer 4 composed of a fire retardant material is attached with glue or other attachment means which do not pierce the second layer and extends over the edges of the first layers. Preferably the fire retardant material is polychloroprene foam having a thickness of 0.25 to 1.0 inch and most preferred having a thickness of 0.5 to 0.75 inch.

A fire resistant shield composed preferably of two strips of fiber glass cloth coated with a thin layer of a resin such as plasticized polyvinyl chloride is attached to the overlap portion of the second layer with glue to form a glue weld 5. Polychloroprene foam also commonly known as Neoprene tends to char when subjected to heat and flames, therefore, to minimize the glue weld weakening when subjected to heat, it is preferable to glue the fire resistant shield to the bottom side of the Neoprene foam to protect the glue weld. The strips of cloth are of sufficient width that when they are sewn together with fiber glass thread to form stitches 12 or otherwise attached to each other they form a fire shield which has sufficient slack to permit the springs to expand without rupturing the mattress. The fire resistant shield can be made of a polyaramid such as Kevlar.

The slack, e.g., the additional fire shield which allows the mattress to expand as described above, is conveniently folded or "tucked" into channel 19 which extends the entire perimeter of the mattress. The folded excess fire shield is held in place by a retractor band 8 having a circumference slightly smaller than the perimeter of the mattress and it is sufficiently resilient that it is placed in position by stretching around the perimeter of the mattress. The retractor band is made of a material which will burn in a moderate fire to release the fire shield in the event the mattress is exposed to flame or is ignited. The material can be ticking, canvas or similar materials. The width of the retractor band is preferably 1 to 2 inches more or less and the thickness is the same as ticking or canvas.

Another embodiment of my invention has a fire shield without said slack. This embodiment similar to the main embodiment has a surface under the cover which does not support combustion except in extremely high temperatures. Naturally, this embodiment does not require the retractor band.

The mattress with retractor band in place is covered with a mattress cover 6 made of satin ticking, fabric, fire resistant fabric or similar material. The cover is made by sewing top and bottom panels and the side panels 9 by means of ribbing strips 10 which is conventional in the mattress making art.

Figure 8:
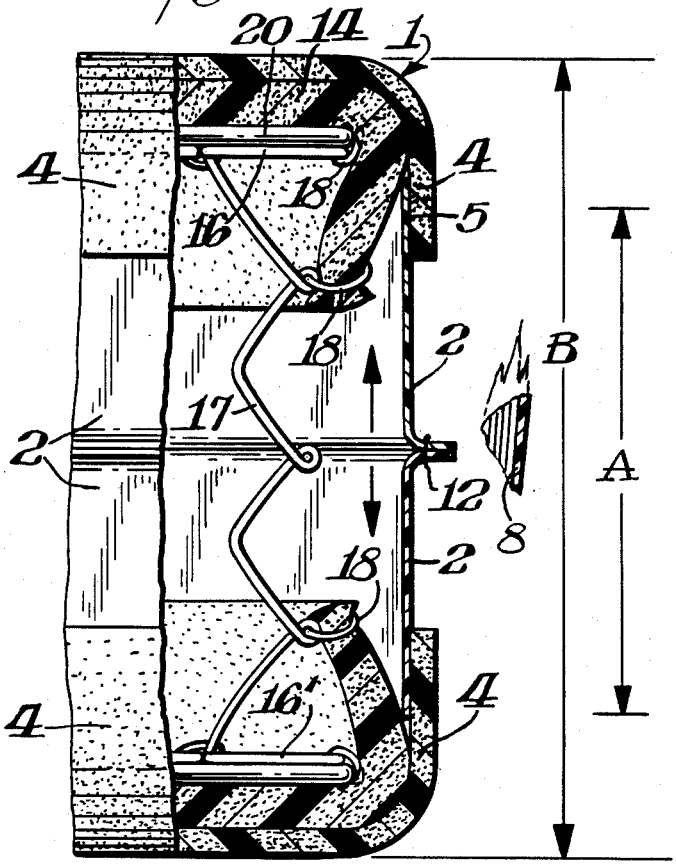
FIG. 8 is a cross-sectional view partially broken away illustrating the mattress of FIGS. 1 through 7 which has been exposed to heat and/or flame and has expanded in size.

In FIG. 8 the mattress in expanded position is shown. The retractor band 8 has burned away and heat has caused the springs to expand. The inner contents including degradation products are maintained within the capsule formed by the second layers and the fire shield.

Figure 10:
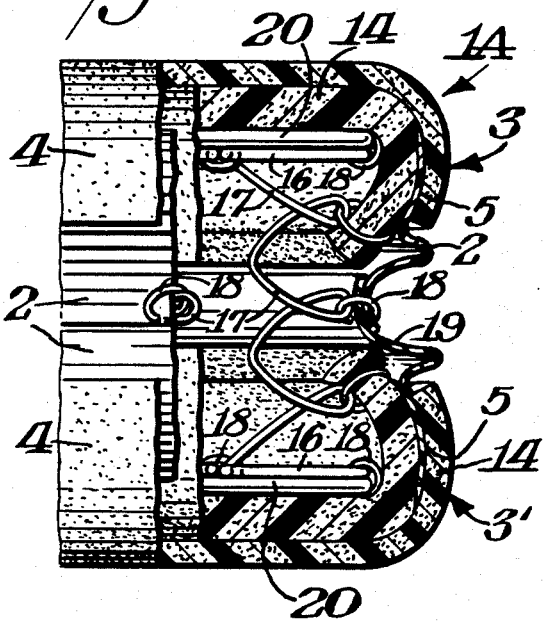
FIG. 10 is a fragmental side-elevational view with portion in cross-section of still another embodiment.

In FIG. 10, 1A is another embodiment of the mattress of this invention, wherein the fire shield 2 is attached at a midpoint by hog rings 18 around the periphery of the mattress, to the outermost springs 17 of the mattress. This embodiment eliminates the need of a retractor band to hold the slack of the fire shield in place. In this embodiment, the fire shield is of a sufficient width to permit the expansion of the metal springs 17 without said expanding springs rupturing or breaking through the surface of the mattress, thus exposing to flame the flammable inner materials of the mattress.

Figure 11:
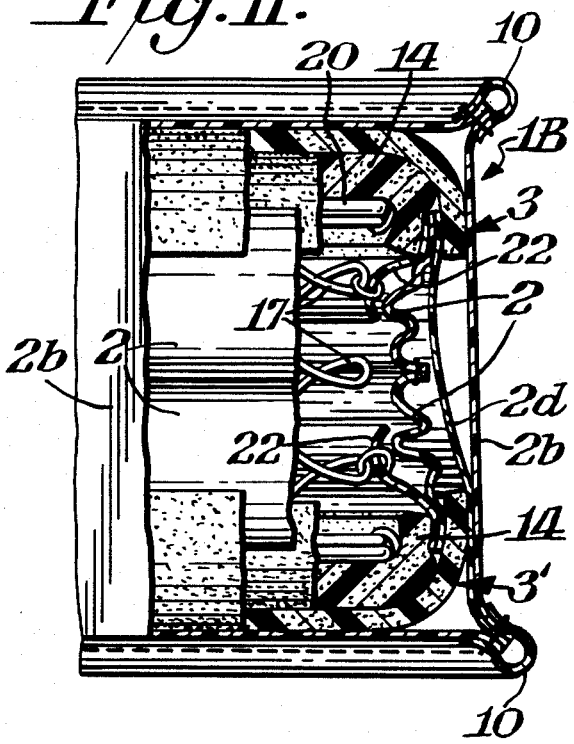
FIG. 11 is a fragmental side-elevational view with portion in cross-section of yet another embodiment.

In FIG. 11, 1B is still another embodiment of the invention with eliminates movement or displacement of the cover of the mattress on bending or folding of the mattress. In this embodiment, an additional strip of material **2*d* which burns in a moderate fire is attached to the embodiment in FIG. 9, around the periphery of the mattress with glue or attached using other convenient methods to the top fire retardant layer 3 and without slack. This strip of material covers the fire shield 2 and is similarly attached to the lower cover around the periphery of the mattress at the edging 10. A second strip 2*b* of the same material or cover material is attached between the top and bottom cover at the edging 10 around the entire periphery the mattress. The slack fire shield is retained within the channel or pocket formed by said strip 2** lessening the need for a retractor band.

Figure 12:
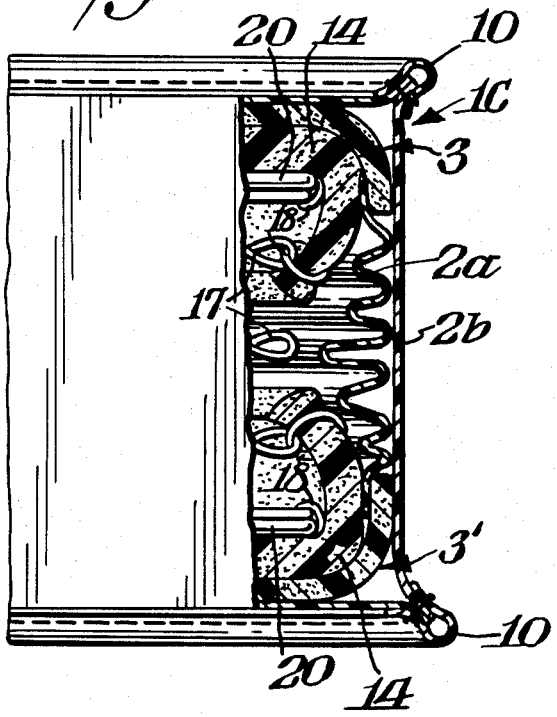
FIG. 12 is a fragmental side-elevational view with portion in cross-section of still another embodiment.

In FIG. 12, **1*c* is yet another embodiment of the invention wherein the fire shield 2*a* is a single strip of fire retardant material attached around the periphery of the mattress to the upper fire retardant layer 3 and the lower fire retardant layer 3. In this embodiment, the use of a retractor band is optional since the cover 2*b*** contains the retractor band in place.

As stated herein, my invention is directed to a mattress having the inner component enclosed in a fire retardant capsule or bag to produce a mattress having a complete fire retardant surface and said surfacee having sufficient fire retardant material to allow the springs contained therein to thermally expand causing the mattress to expand in overall volume. The result is a mattress which when exposed to flame or heat sufficient to cause the springs to expand is capable of being exposed to said flame or heat without the springs rupturing the surface of the mattress or otherwise losing its structural integrity due to the thermal warping or expansion of the metal springs and metal frame holding said springs.

The mattress is shown in normal conditions to have a height represented by A generally 4 to 8 inches and after exposure to heat the mattress has expanded to nearly double the width of the normal mattress, that is, to a width of B.

Figure 9:
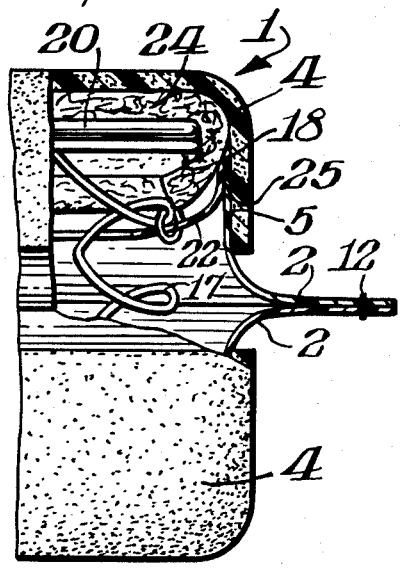
FIG. 9 is a fragmental side-elevational view partially broken away illustrating a modified construction of a fire retardant mattress.

In FIG. 9, an alternate embodiment of the invention, a smaller section of the fire shield fiber glass material 22, is attached at one end to the overlap over the edge of the frame of the fire retardant foam layers and is attached at the other end to the outermost springs with foam anchor or hog rings. The attachment of the smaller section of material or fire shield fiber glass material can be made with glue to form a glue weld 25 at the point of attachment of the fire shield to the overlap of the fire retardant foam layer. In this alternate embodiment when the first layer placed on the top and bottom of the spring support is a non-woven mat then it is not convenient to glue the second layer to the first layer. A problem is then created because the first and second layers tend to slide over each other. The smaller section of canvas or fire shield holds the non-woven mat in place thereby eliminating the above problem or efficiency in the use of non-woven matting.

As stated above, the second layer is preferably polychloroprene, various polychloroprenes, especially low smoke producing foamed polychloroprenes which are commercially available. The polyurethane foam used is readily commercially available and is well-known in this art. The polyurethane foam in general, weighs about two to four pounds per cubic foot of foam. The cover material is preferably a boric acid, treated fabric or other flame resistant fabric such as Nomex and Kevlar sold by E. I. DuPont de Nemours Company which can be used for human contact and which is fire resistant. The glue used to manufacture the mattress is preferably a polychloroprene based glue readily commercially available.

While the above discussion has been concentrated on the mattress embodiment of this invention, the above disclosure is equally applicable to seat cushions and upholstery in general and the term mattress herein is defined to include seat cushions and the like.

The mattress of this invention is particularly useful for use in hospitals where beds are equipped with a device which raises either the head, foot or both of the mattress for the patient's comfort or for feeding purposes. Prior art fire retardant mattresses are not flexible and these mattresses are broken apart by raising or folding of the mattress. The present mattress is capable of being raised as aforesaid without rupturing the fire shield.

The mattress of this invention is designed to substantially reduce human contact with the fiber glass fire shield which is greatly desirable. Fiber glass fabric tends to produce glass splinters which are a skin irritant and, therefore, preferably not used for manufacturing bedding, however, in the novel mattress described herein, fiber glass fabric can be used since contact therewith is minimized by the polychloroprene foam and the retractor band.

The mattress of this invention can be made by the steps comprising anchoring with hog rings or hog anchor clamps to the top and bottom of a coiled spring in a frame assembly a first layer of polyurethane foam and/or cotton matting or both. Preferably, the top of the first layer is polyurethane. The top portion or outermost surface of the first layers were coated with a polychloroprene based glue. The first layer preferably is larger than the perimeter and/or extends over the spring assembly of the mattress and the first layer is wrapped around the edges of the top and bottom of the springs and clamped to the outermost springs with hog rings. The amount of overlap was about 1 to 3 inches. Two sheets of polychloroprene foam making up the second layer on the top and bottom sides are made as follows: around the four edges of a sheet of polychloroprene foam having a thickness of 0.4 to 0.75 inch and having a length and width about 1 to 3 inches greater than the first layer was glued, with a polychloroprene based glue to a strip of fiber glass fabric having a width of about to four to twelve inches. The foam glue overlap, which was about two inches in width, formed a glue weld between the foam and fabric. The center portion of the polychloroprene foam sheet was coated with the glue and then allowed to dry and thereafter was placed adjacent to a similarly glued first layer of polyurethane foam or matting on the frame. The second foam fiber glass fabric is similarly attached to the first layer on the bottom side of the mattress. The two fiber glass fabric strips are attached to each other at a point approximately 0.5 inch from the second side of each strip using glue or fiber glass thread stitching. The excess or slack fiber glass strip is folded within the channel formed by the first and second layers on the top and bottom of the spring frame and the outermost springs or the side of the resilient spring assembly support and held in place with a canvas or cotton retractor band and covered with a cover in the usual manner with ticking cotton fabric or treated cotton fabric.

Although certain preferred embodiments have been described, it should be understood that various modifications within the spirit and scope of the invention are possible.

I claim:

1. A fire retardant mattress comprising:

(a) a central resilient spring assembly support comprising a plurality of coiled springs arranged in a frame having a top side, a bottom side and a peripheral edge separating the top and bottom sides;

(b) a first layer comprising resilient polyurethane foam, matting or a combination of polyurethane foam and matting attached to and covering each said top and bottom sides of the resilient spring assembly support and extending beyond the top side edge and the bottom side edge to form a channel comprising the springs in the resilient spring assembly support and the extension of the first layers extending over said top and bottom edges;

(c) a second layer comprising a resilient fire retardant material placed adjacent to and covering the first layer attached to the top and bottom sides of the resilient spring assembly support; and (d) a fire shield composed of a flame resistant material attached to said second layers at the point of extension over said top and bottom edges of the resilient spring assembly support completely encapsulating said first layer covered resilient spring assembly support within a substantially fire retardant capsule capable of expanding due to the thermal expansion of the springs and resilient spring assembly support.

2. The mattress of claim 1 wherein the second layer is foamed polychloroprene, and the fire shield has a width which will allow the springs to expand double in height.

3. A fire retardant mattress comprising:

(a) a central resilient spring assembly support comprising a plurality of coiled springs arranged in a frame having a top side, a bottom side and a peripheral edge separating the top and the bottom sides;

(b) a first layer comprising resilient polyurethane foam or matting or a combination of polyurethane foam and matting attached to and covering each said top and bottom sides of the resilient spring assembly support and extending beyond the top side edge and the bottom side edge up to three inches to form a channel comprising the resilient spring assembly support and the extension of the first layers extending over said top and bottom edges;

(c) a second layer composed of polychloroprene foam having a thickness of 0.5 to 1.0 inch placed adjacent to and covering the first layer attached to the top and bottom sides of the resilient spring assembly support;

(d) a fire shield composed of fiber glass cloth or coated fiber glass cloth attached to said second layers for second layer at the point of extension over said top and bottom edges of the resilient spring assembly support completely encapsulating said central resilient spring assembly support and first layers within a substantially fire retardant capsule and having a slack portion folded upon itself which will permit the springs in the resilient spring assembly support to expand up to double in height;

(e) a retractor band composed of a material which will burn when exposed to flame selected from the group consisting of ticking and canvas having a perimeter slightly smaller than the mattress placed over excess fire shield folded within the channel to retain the excess fire shield in place; and (f) a cover composed of a material selected from the group consisting of ticking, cotton fabric and flame resistant treated cotton fabric covering said encapsulated mattress.

4. A fire retardant mattress comprising:

(a) a central resilient spring assembly support comprising a plurality of coiled springs arranged in a frame having a top side, a bottom side and a peripheral edge separating the top and bottom sides;

(b) a first layer comprising resilient polyurethane foam, matting or a combination of polyurethane foam and matting attached to and covering said top and bottom sides of the resilient spring assembly support and extending beyond the top side edges and the bottom side edges to form a channel comprising the springs in the resilient spring assembly support and the extension of the first layers extending over said top and bottom edges;

(c) a second layer comprising a resilient fire resistant polychloroprene foam placed adjacent to and covering the first top and bottom layers said second layer having a peripheral edge; and (d) a fire shield composed of a flame resistant material having a peripheral edge which is attached to the peripheral edge of said second layers completely encapsulating said first layer covered resilient spring assembly within a substantially fire retardant capsule wherein said fire shield has a slack portion folded upon itself with a width which permits the mattress to expand up to double in height due to thermal expansion of the springs and resilient spring assembly support when subjected to flame or heat without rupturing the top and bottom layers; and (e) a retractor band comprising a circular band having a circumference slightly smaller than the perimeter of the mattress said retractor band being composed of a material which will burn when exposed to flame or heat.

5. The mattress of claim 4 wherein the second layer is composed of polychloroprene foam and has a thickness of 0.25 to 1.0 inch and the fire shield is composed of fiberglass cloth or coated fiberglass cloth.

6. The mattress of claim 5 covered with a cover selected from the group consisting of ticking, cotton fabric and flame resistant treated cotton fabric.

7. The mattress of claim 5 in the form of a seat cushion.

* * * * *